US006087019A

United States Patent [19]

Isobe et al.

[11] Patent Number: 6,087,019

[45] Date of Patent: Jul. 11, 2000

[54] PLATED STEEL SHEET

[75] Inventors: Makoto Isobe; Chiaki Kato; Kazuhiro Seto; Masaaki Kohno, all of Chiba, Japan

[73] Assignee: Kawasaki Steel Corporation, Hyogo, Japan

[21] Appl. No.: 09/194,389

[22] PCT Filed: May 30, 1997

[86] PCT No.: PCT/JP97/01850

§ 371 Date: Nov. 30, 1998

§ 102(e) Date: Nov. 30, 1998

[87] PCT Pub. No.: WO97/45569

PCT Pub. Date: Dec. 4, 1997

[30] Foreign Application Priority Data

May 31, 1996 [JP] Japan ..... 8-159240
May 31, 1996 [JP] Japan ..... 8-159241

[51] Int. Cl.[7] ..... B32B 9/00

[52] U.S. Cl. ..... 428/472; 428/469; 428/472.1

[58] Field of Search ..... 428/472, 472.1, 428/469

[56] References Cited

FOREIGN PATENT DOCUMENTS 55-122865 9/1980 Japan .
61-147865 7/1986 Japan .
63-47356 2/1988 Japan .
63-216976 9/1988 Japan .
63-235485 9/1988 Japan .
2-194156 7/1990 Japan .
4-329892 11/1992 Japan .
5-106000 4/1993 Japan .
5-106001 4/1993 Japan .
6-41708 2/1994 Japan .
6-212384 8/1994 Japan .
6-279967 10/1994 Japan .
8-170160 7/1996 Japan .
8-225897 9/1996 Japan .
8-246121 9/1996 Japan .

*Primary Examiner*—Deborah Jones
*Assistant Examiner*—Jason D Resnick
*Attorney, Agent, or Firm*—Young & Thompson

[57] ABSTRACT

This invention is a plated steel sheet formed by laminating an iron oxide layer and a plated layer on a steel matrix in this order, in which excellent plating adhesion property can uniformly be given to a full surface of the steel sheet by disposing a connection portion made from a metallic iron or an iron alloy connecting the steel matrix to the plated layer in the iron oxide layer. Particularly, it can provide means for easily forming a plated layer having an excellent adhesion property through hot dipping can be given to steel sheets being difficult to conduct the hot dipping such as high-strength steel sheet, stainless steel sheet and the like.

5 Claims, 4 Drawing Sheets

(Excellent) 1/ no change in plated face after the peeling of the tape

2/ small hairiness in plated test portion after the peeling of the tape

3/ small peeling in plated test portion after the peeling of the tape (Poor) 4/ peeling in a greater part of plated test portion after the peeling of the tape Example measuring
density index : D=4/0.295 = 13.6portions/mm (Excellent) 1/ no change in plated face after the peeling of the tape 2/ small hairiness in plated test portion after the peeling of the tape 3/ small peeling in plated test portion after the peeling of the tape (Poor) 4/ peeling in a greater part of plated test portion after the peeling of the tape

PLATED STEEL SHEET

TECHNICAL FIELD

This invention relates to a plated steel sheet used as a can producing material, a building material, steel sheets for air conditioner and water heater, steel sheets for automobiles and the like which require a high corrosion resistance.

BACKGROUND ART

In general, the production of the plated steel sheet is carried out by subjecting a raw material for the plated steel sheet to hot rolling, removing an iron oxide layer covering the surface of the steel sheet in a pickling equipment, subjecting to cold rolling, if necessary, and then subjecting to plating in a continuous hot dipping apparatus, an electric plating apparatus or the like. The reason why the removal of the iron oxide layer is essential in this method is due to the fact that the iron oxide layer obstructs the plating and results in a start point of peeling a plated layer to degrade the adhesion property of the plated layer.

On the other hand, JP-A=6-279967 proposes that reduction treatment is carried out in a reducing gas atmosphere without removing the iron oxide layer and thereafter hot dip galvanizing is conducted in the production of hot dip galvanized hot rolled steel sheets. Concretely, the reduction treatment is carried out in a $H_2$ atmosphere having a high concentration of 75%.

According to the above method, the hot dip galvanizing not forming non-plated portion is realized by sufficiently conducting the reduction in a heating furnace of a continuous hot dipping apparatus without removing the iron oxide layer. However, since the $H_2$ concentration as a reducing atmosphere is high, the pickling cost is reduced, while the cost required for the heating furnace of the continuous hot dipping apparatus largely increases.

If it is intended to plate a cold rolled raw material not requiring the reduction of the iron oxide layer in the same continuous hot dipping apparatus as mentioned above, it is necessary to change the $H_2$ concentration to about not more than 10% because if the iron oxide layer is not existent, hydrogen is absorbed in the inside of the steel sheet during the heating and then discharged from the steel when the steel sheet becomes low temperature after the plating and hence it is vaporized at an interface to the plated layer to cause local peeling of the plated layer. Therefore, the change of the $H_2$ concentration brings about the lowering of the productivity and the increase of the cost.

DISCLOSURE OF THE INVENTION

It is a main object of the invention to provide a novel plated steel sheet solving the above problems by positively retaining an iron oxide layer in a steel sheet plated without removing the iron oxide layer and optimizing a structure of the iron oxide layer.

It is another object of the invention to provide means for providing a plated layer having an excellent adhesion property to an alloy steel being weak in the hot dipping such as high-strength steel sheet, stainless steel sheet, electromagnetic steel sheet or the like through the hot dipping.

That is, in the alloy steel sheet such as high-strength steel sheet, stainless steel sheet or the like, the alloying components such as Si, Mn and Cr are selectively oxidized at an annealing step before the hot dipping treatment to concentrate on the surface of the steel sheet as an oxide and hence the formation of non-plated portion and the lowering of the adhesion property of the plated layer are inevitably caused. In order to realize the hot dipping in these steel sheets, therefore, there are proposed a method wherein an electric plating is carried out prior to the hot dipping in the high-strength steel sheet (see JP-A-61-147865 and JP-A-2-194156) and a method wherein oxidation is carried out and reduction is carried out and then plating is conducted in a continuous hot dipping line (see JP-A-55-122865 and JP-A-6-41708). Similarly, in case of the stainless steel sheet, there are proposed a method wherein an electric plating is carried out prior to the hot dipping (see JP-A-63-47356 and JP-A-63-235485) and a method wherein the hot dipping is carried out after a passive film is treated with an acid (see JP-A-8-225897). Thus, in order to apply the hot dipping to the alloy steel sheet, it is necessary to take complicated steps prior to the hot dipping, so that it is desired to realize the hot dipping by more simple means.

In order to particularly investigate the relation between structure of iron oxide layer and plating properties in the steel sheet subjected to the plating at a state of retaining the iron oxide layer, the inventors have conducted the plating after the steel sheet retaining the iron oxide layer is first reduced under various reduction conditions and then examined the plating properties of the plated steel sheet and observed the structure of the iron oxide layer in the steel sheet. As a result, it has newly been found that since the plating properties are not necessarily improved in proportion to a reduction depth from the surface of the iron oxide layer, a particular structure is given to the iron oxide layer interposed between steel matrix and the plated layer without quantifying the depth of the reduction region, which is very advantageous to the improvement of the plating properties and the invention has been accomplished.

At first, a connection portion made from a metallic iron or an iron alloy connecting the steel matrix to the plated layer is disposed in the iron oxide layer. And also, it has been found that the excellent plating properties are obtained over a full surface of the steel sheet by defining conditions of existing the connection portion in the iron oxide layer, whereby there is provided a sound plated steel sheet having no local peeling of the plated layer.

That is, the invention is a plated steel sheet formed by laminating an iron oxide layer and a plated layer on a steel matrix in this order, characterized in that a connection portion made from a metallic iron or an iron alloy connecting the steel matrix to the plated layer is included in the iron oxide layer.

The connection portion is very advantageous to improve the adhesion property when it follows the following condition (I) or (II).

(I) A total length of the connection portion contacting with the plated layer at a section in a thickness direction of a plated steel sheet is not less than 0.1 mm per 1 mm of an interface among the plated layer, iron oxide layer and connection layer.

Moreover, the length of the connection portion and the length of the plated interface are determined by observation of the section over a length of at least 250 $\mu$m.

(II) The connection portion has a density index D defined by the following equation (1) of not less than 20:

$$D=(D_L^2+D_C^2)^{1/2} \quad (1)$$

where $D_L$: number of connection portions in a rolling direction at the section in the thickness direction of the iron oxide layer (portions/mm)

$D_C$: number of connection portions in a direction perpendicular to the rolling direction at the section in the thickness direction of the iron oxide layer (portions/mm).

Moreover, the density index D is determined by the calculation according to the equation (1) from the number of connection portions per 1 mm, which is converted from observation results over not less than 250 μm in the rolling direction at the section in the thickness direction of the iron oxide layer (hereinafter referred to as L direction) and in the direction perpendicular to the L direction (hereinafter referred to as C direction), respectively, when the connection portions are approximately straight lines parallel to each other.

And also, the invention is particularly advantageously adaptable to not only plated steel sheets having a general chemical composition but also steel sheets having a composition inclusive of a component concentrated in the surface of the steel sheet during the annealing such as high-strength steel sheet and stainless steel sheet.

In the invention, it is important that the connection portion made from a metallic iron or an iron alloy connecting the steel matrix to the plated layer is disposed in the iron oxide layer as the section of the adaptable plated steel sheet is shown in FIG. 1. And also, it is favorable that the connection portions are dotted on the surface of the iron oxide layer in land form in order to avoid the feature that a plated portion peeled from the connection portion and having an insufficient adhesion force has an expanse in plane.

In the plated steel sheet having the section shown in FIG. 1, the connection portion is disposed in the iron oxide layer so that a sum of lengths of the connection portions contacting with the plated layer (hereinafter referred to as a total length) at a section in its thickness direction is not less than 0.1 mm per 1 mm of an interface among the plated layer, iron oxide layer and connection portion (hereinafter referred to as an interface simply).

That is, as results when a ball impact test is carried out at an impact core diameter of ½ inch, a dropping load of 2 kg and a dropping distance of 70 cm with respect to each of steel sheets having connection portions of various total lengths are shown in FIG. 2, when the total length of the connection portions on the surface of the iron oxide layer is not less than 0.1 mm per 1 mm of the interface, the plating adhesion force becomes very high. Therefore, there can be obtained a strength not causing the peeling of the plated layer against shock or work applied to the plated steel sheet.

On the other hand, in case of the alloy steel sheets, the action of controlling the surface concentration of the alloying component is expected in the iron oxide layer as mentioned later, so that it is required that the iron oxide layer is surely existent between the steel matrix and the plated layer. In this case, therefore, it is preferable that the total length of the connection portions is not more than 0.9 mm per 1 mm of the interface.

Then, the connection portion made from the metallic iron or the iron alloy connecting the steel matrix to the plated layer is disposed in the iron oxide layer even in the plated steel sheet having a section shown in FIG. 3. The illustrated plated steel sheet is particularly provided with the connection portions so that the density index D defined by the equation (1) is not less than 20.

That is, the reason why the density index D is limited to not less than 20 is due to the fact that as experimental results when a ball impact test is carried out at an impact core diameter of ½ inch, a dropping load of 2 kg and a dropping distance of 70 cm with respect to each of steel sheets having various density indexes D are shown in FIG. 4, if the density index D is less than 20, the plating adhesion force is very high. On the other hand, the upper limit of the density index D is not particularly restricted, but is sufficiently effective to be about 30 from a viewpoint of the elimination of locally forming the connection portion having a small density.

Moreover, the shape of the connection portion is not particularly restricted unless the connection portion connects the steel matrix to the plated layer, but is desirable to have a width of not less than 0.5 μm. Because, when the width is less than 0.5 μm, the strength of each connection portion becomes small but also the existence of the connection portion can not be observed at the section and it is unfavorable from a viewpoint of product control.

Further, the invention is advantageously adaptable to steel sheets, which have hitherto restricted the application of the hot dipping, having a composition inclusive of components concentrating in the surface of the steel sheet in the annealing, concretely in the course of from the annealing to immersion of the steel sheet into a hot dipping bath after the annealing.

That is, when this type of the steel sheet is treated in a continuous hot dipping line after the removal of the iron oxide layer, Si, Mn, Cr and the like in steel are selectively oxidized by a slight amount of oxygen or steam existing in a furnace during the annealing or in the course of the immersion of the steel sheet into the hot dipping bath after the annealing to concentrate in the surface of the steel sheet as an oxide and hence it is disadvantageous to create non-plated portion or poor plating adhesion property. However, when the iron oxide layer is retained in the presence of the connection portion according to the invention, the components in steel such as Si, Mn, Cr and the like take oxygen in iron oxide at the interface between the iron oxide layer and the steel matrix to form an oxide, which is precipitated in steel and hence the precipitation of these components onto the surface of the steel sheet is avoided. Therefore, a factor obstructing the plating adhesion is solved and also since the steel matrix is strongly connected to the plated layer through the connection portion, the plating adhesion property is considerably improved.

The concrete means for obtaining the plated steel sheet according to the invention is described with reference to the case of hot dip galvanizing below.

At first, a steel material as a steel matrix for the plated steel sheet is rolled to a given thickness in a hot rolling installation and then transferred to a hot dipping installation. In this case, the components of the steel material for the plated steel sheet are not particularly restricted as far as they have a general chemical composition for the plated steel sheet, and may properly be adjusted at a steel-making step in accordance with the properties required in the plated steel sheet. That is, the invention is applicable to not only the general chemical composition for the plated steel sheet but also steel sheets, which have hitherto been restricted in the application, having a composition inclusive of components concentrating in the surface of the steel sheet during the annealing such as high-strength steel sheet, stainless steel sheet, electromagnetic steel sheet and the like. In this case, there are Si, Mn, Cr, Al, Ti, Nb, P, B and the like as the component concentrating in the surface of the steel sheet during the annealing. In case of the steel sheet having a composition that the total amount of these components exceeds 1 wt %, the surface concentration becomes remarkable during the annealing.

Incidentally, the high-strength steel sheets subjected to hot dipping can be used in not only inner panel, chassis and reinforcement of an automobile but also building materials, floor member and terrace member of a building, guard member in a construction site, framework and the like, while the stainless steel sheets subjected to hot dipping can be used in various members of an exhaust gas system of an automobile, building materials used under severer environment (seaside site and the like) and so on.

In the hot rolling step, it is favorable that sufficient descaling is carried out just before finish rolling or that a final finish rolling temperature is made lower to reduce the thickness of the iron oxide layer to, for example, not more than about 5 μm. Incidentally, the thickness of the iron oxide layer is about 5 μm at the final finish rolling temperature of 750~800° C. though it is dependent upon the cooling conditions after the finish rolling. The thickness of the iron oxide layer tends to decrease with the increase of the components in steel.

Then, a hot dip galvanized steel sheet is obtained by conducting reduction treatment in a hot dipping installation and thereafter immersing in a plating bath to conduct the plating. In this case, the iron oxide layer produced on the surface of the steel sheet in the hot rolling step is not completely reduced in an annealing furnace, so that the iron oxide layer remains on the steel sheet surface, but prior to the immersion into the plating bath is carried out a treatment so that the connection portions made from a metallic iron or an iron alloy connecting the steel matrix to the plated layer in the plated steel sheet are disposed in the iron oxide layer. Particularly, it is advantageous that (I) the total length of the connection portions at the section in the thickness direction of the plated steel sheet is not less than 0.1 mm per 1 mm of the interface, or (II) the density index D is not less than 20. In order to realize the structure of the iron oxide layer, it is recommended to conduct, for example, the following treatments.

(I) total length of connection portions: not less than 0.1 mm per 1 mm of interface The annealing conditions applied to the steel sheet after the hot rolling, concretely hydrogen concentration, temperature and time in an annealing furnace are adjusted properly. As preferable conditions, there are exemplified hydrogen concentration: 30%, temperature: not lower than 770° C., more preferably 770~950° C. and time: 20~120 seconds. However, the conditions are also dependent upon the kind of the steel or the thickness of the iron oxide layer. For example, in case of the steel sheet containing the iron oxide layer of 5 μm, the given total length can be attained by annealing in an atmosphere having a hydrogen concentration of 20% at temperature: not lower than 800° C. and time: not less than 40 seconds and it is possible to sufficiently produce the plated steel sheet in the usual continuous hot dipping equipment. And also, the given total length can be attained at temperature: not lower than 800° C. and time: not less than 80 seconds in an atmosphere having a hydrogen concentration of 8%.

(II) Density index D: not less than 20

Prior to the transfer of the steel sheet after the hot rolling into the annealing furnace, it is easily attained by subjecting the iron oxide layer of the steel sheet to a treatment that the number of cracks corresponding to the density index D of the connection portion are introduced in the thickness direction of the steel sheet. This treatment is particularly effective when the iron oxide layer is thick. Moreover, the conditions of the item (I) can be applied to conditions and the like in the annealing furnace. And also, means such as skin-pass rolling, bending and returning work, tensile work or the like is advantageously suitable for the introduction of cracks. For example, when the steel sheet provided with the iron oxide layer of 8.5 μm in thickness is subjected to skin-pass rolling at a reduction of more than 1% and then treated in a 20% hydrogen atmosphere at not lower than 800° C. and not less than 60 seconds in an annealing furnace of a hot dipping equipment, there is obtained the iron oxide layer provided with the connection portions having a density index D of not less than 20. Moreover, the conditions for the skin-pass rolling, bending and returning work and tensile work are favorable to be determined by the material of the steel sheet to be required in addition to the thickness of the iron oxide layer. On the other hand, the introduction treatment of excessive cracks brings about the peeling of the iron oxide layer in the transfer up to reduction annealing and the like, so that it is favorable to conduct the treatment so as to render the density index D into not more than about 400.

And also, when the density index D of the connection portions in the iron oxide layer is less than 20, the peeling is caused in the iron oxide layer or from an interface between the iron oxide layer and the steel sheet by shock or bending work and hence the resulting product is not durable to put into practical use as previously mentioned.

Moreover, when the treatment is carried out in the annealing furnace by using an atmosphere having a high hydrogen concentration over a long period of time, the iron oxide layer is completely reduced and hence good plating is naturally attained, but it is considerably unfavorable in economical reasons. Therefore, this treatment can not be adopted in the industrial production but also sets off the economical effect inherent to the invention based on the omission of the removal step of the iron oxide layer, which has necessarily been required in the conventional plating treatment.

Incidentally, when the hot dipping equipment is used to both hot rolled steel sheet having the iron oxide layer and cold rolled steel sheet, if the hot rolled steel sheet is treated in a high $H_2$ atmosphere for the reduction of all iron oxide layer, it is required to replace the atmosphere with a new atmosphere before the treatment of the cold rolled steel sheet. Because, if the cold rolled steel sheet is treated in the same high $H_2$ atmosphere as in the hot rolled steel sheet having the iron oxide layer, hydrogen is absorbed in the steel sheet in the annealing of the cold rolled steel sheet and then hydrogen is discharged after the plating but has nowhere to go and hence it evaporates at the interface to the plated layer to cause local peeling of the plated layer.

When the steel sheet having a surface activated by disposing the connection portions in the iron oxide layer through the given reduction treatment in the annealing furnace of the hot dipping equipment according to the above procedure is subjected to hot dip galvanization, it is favorable that the steel sheet is previously cooled to about a temperature of molten metal and then introduced and immersed in the plating bath. For example, in case of the hot dip galvanization in a plating bath containing 0.15~0.2 wt % of Al, the bath temperature is general to be 450~500° C., but in order to control the growth of Zn-Fe alloy produced at the interface between the plated layer and the reduced iron, it is desirable to conduct the introduction of the steel sheet after the cooling to not higher than about 500° C. And also, it s possible to contact only one-side surface of the steel sheet with a metal for the hot dip galvanization through a meniscus process to conduct one-side plating instead of the immersion.

As the zinc-based plating bath, it is possible to include Al, Mg, Mn, Ni, Co, Cr, Si, Pb, Sb, Bi, Sn and the like alone or in admixture for improving the various properties in addition to Zn and Fe.

Finally, the steel sheet plated by the immersion is adjusted to a required coating weight within a range of 20~250 g/m$^2$ by gas wiping or the like and thereafter cooled by gradual cooling, air cooling, water cooling or the like and then subjected to temper rolling with a leveler, if necessary, to obtain a product. And also, it is possible to conduct a chromate treatment, a phosphate treatment or the like after the cooling or the temper rolling for improving the corrosion resistance and the like and it is effective to further conduct the painting. At the same time, it is possible to conduct a lubrication treatment as a post treatment.

Although the invention is explained with respect to the hot dip galvanized steel sheet, the invention is applicable to the other hot dipped steel sheets or electroplated steel sheets in addition to the hot dip galvanized steel sheet. For example, the plating treatment such as 55% Al-Zn plating, Al plating, Sn plating, Zn-Ni plating or the like is adaptable. In any case, it is sufficient to dispose the connection portion made from a metallic iron or an iron alloy connecting the steel matrix to the iron oxide layer in the plated layer remaining even after the reduction treatment, and hence the steel sheets having excellent plating properties are obtained irrespectively of the plating process. The continuous hot dip galvanizing apparatus is particularly preferable in the invention because it is common to arrange the plating tank followed to the annealing furnace.

Moreover, the connection portion is made from the metallic iron or the iron alloy, which means that the iron oxide is reduced into the metallic iron by $H_2$ in the annealing before the plating, or that the metallic iron reacts with the plating solution in the hot dipping, e.g. Al containing dot dipping to form an alloy with the hot dipping component, e.g. Al and Zn at the interface. On the other hand, the above alloy formation is not caused in the electric plating, so that it is common to form no iron alloy.

BEST MODE FOR CARRYING OUT THE INVENTION

Example 1

A slab having a steel composition shown in Table 1 is hot rolled to obtain a hot rolled sheet having an iron oxide layer of 0.9 mm in thickness. Then, the hot rolled sheet is cut into a test specimen of 60×200 mm, which is washed with acetone and subjected to a reduction treatment in a vertical type hot metal dipping simulator and thereafter to a hot dip galvanization. In Tables 2 and 3 are shown conditions for the hot rolling and the reduction treatment, and the plating conditions are shown in Tables 4 and 5, respectively. With respect to the thus obtained plated steel sheets, the thickness of remaining iron oxide layer, maximum length at interface of connection portions and total length of connection portions per 1 mm of the interface are measured from an observation of the section after the plating and also the plating adhesion property is evaluated. The measured results are shown in Tables 2 and 3, and the evaluation results are shown in Tables 4 and 5, respectively.

Figure 1:
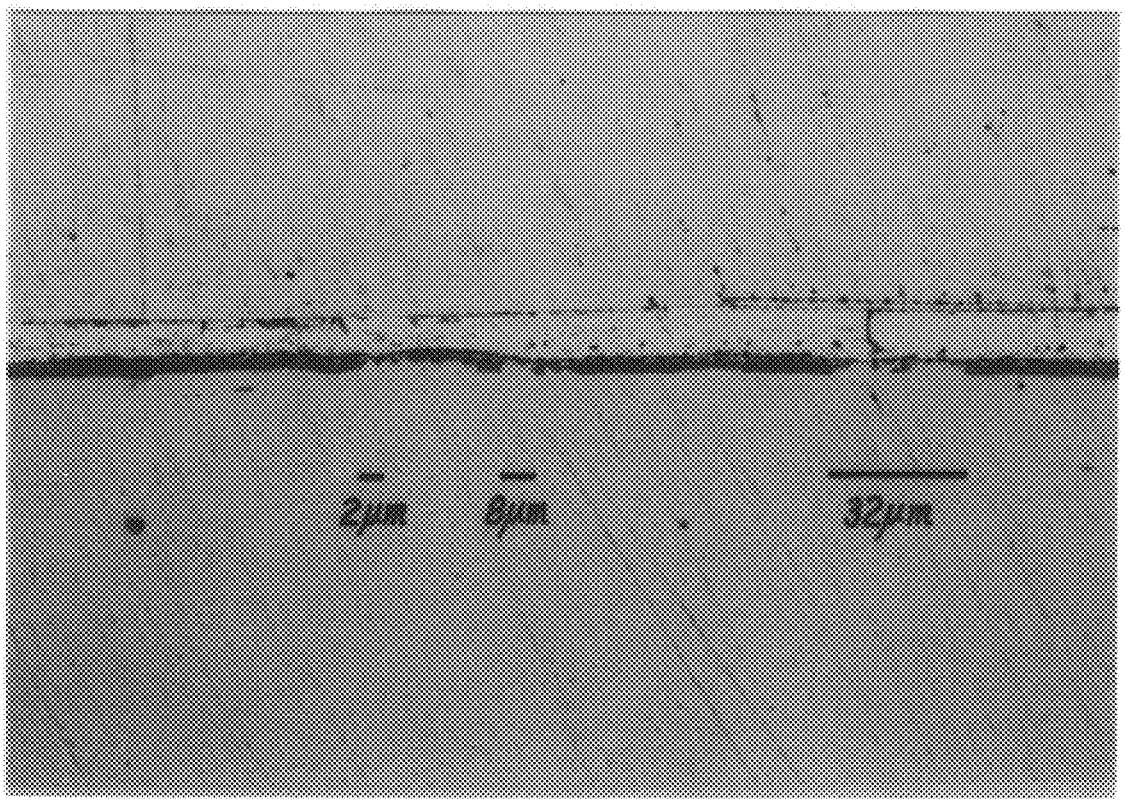
FIG. 1 is a photograph showing a section of a plated steel sheet.
Figure 2:
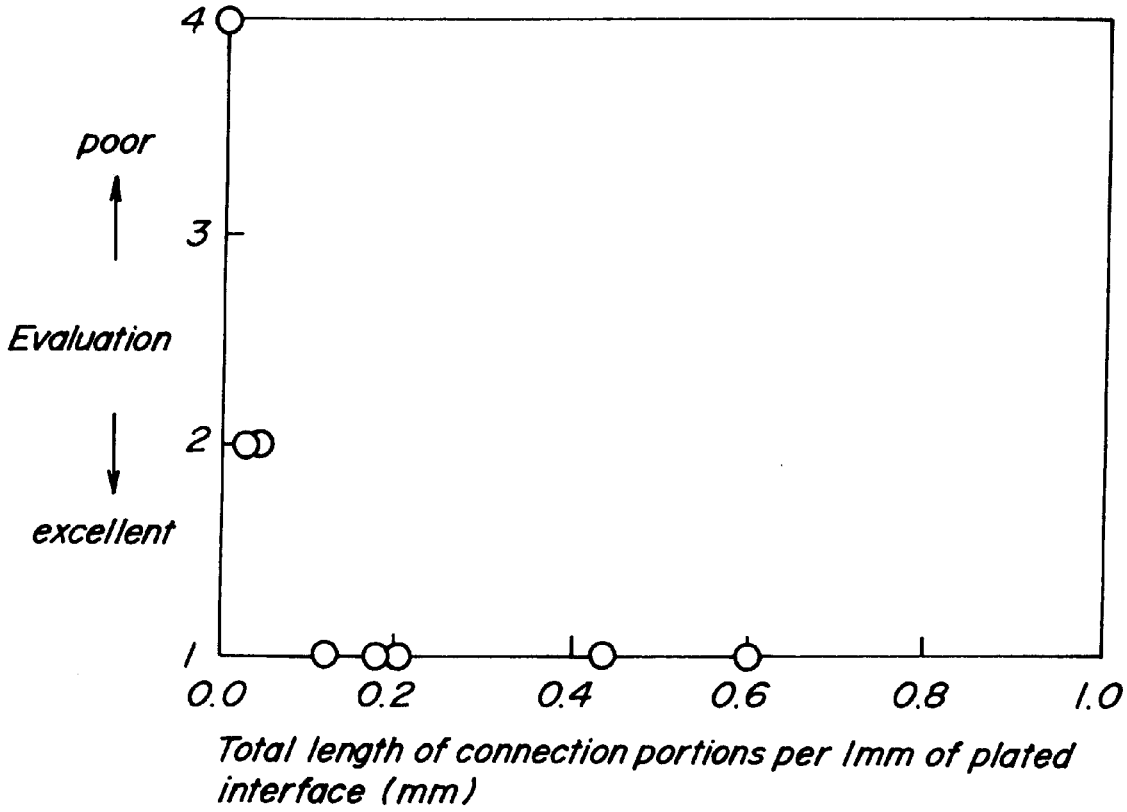
FIG. 2 is a graph showing a relation between plating adhesion property and total length of connection portions.
Figure 3:
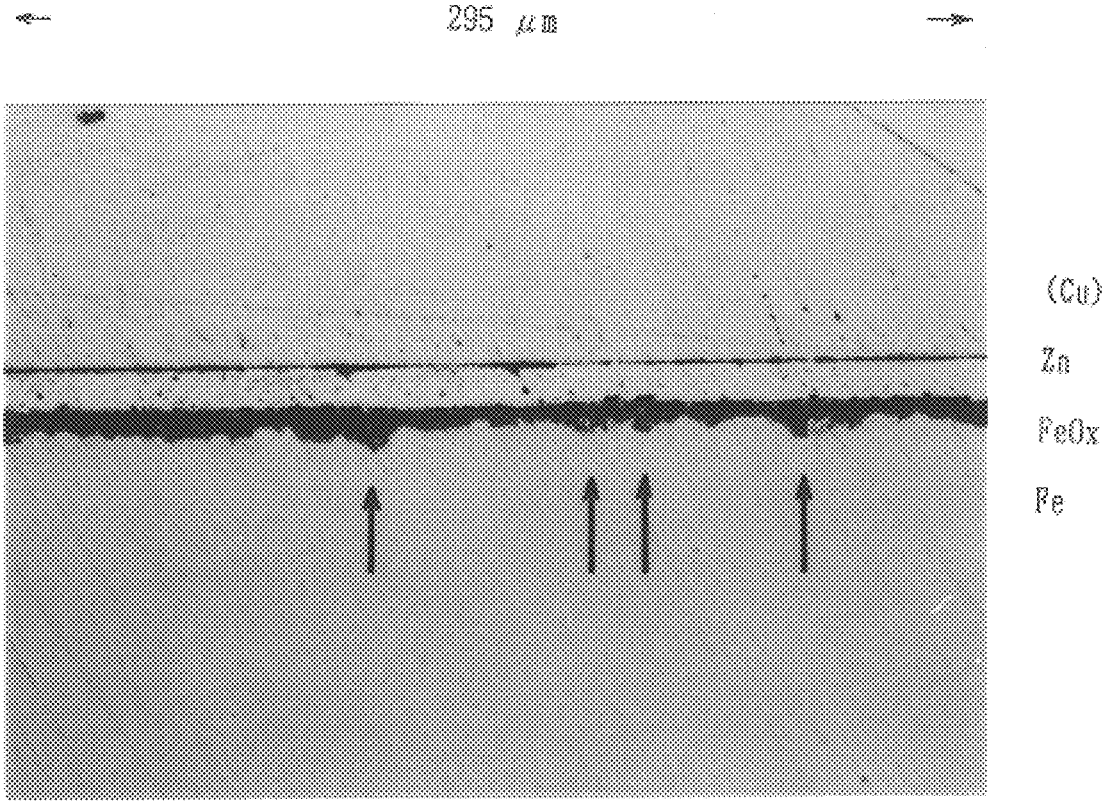
FIG. 3 is a photograph showing a section of a plated steel sheet.
Figure 4:
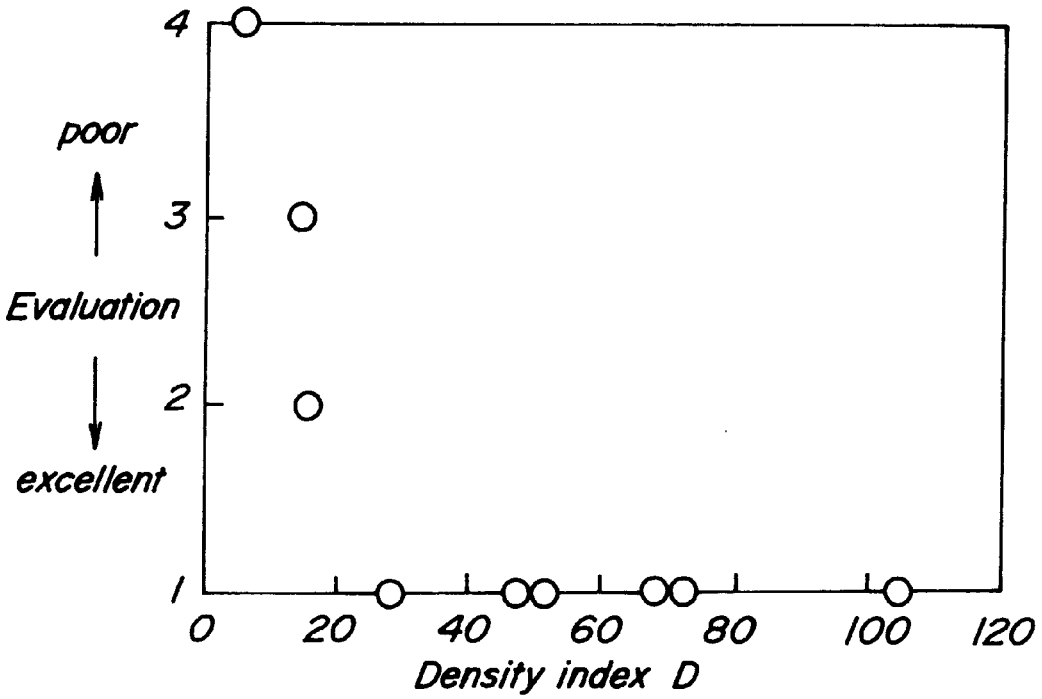
FIG. 4 is a graph showing a relation between plating adhesion property and density index D.

In this case, the maximum length at the interface of the connection portions and the total length per 1 mm of the interface are measured by the observation over a length of not less than 250 $\mu$m in each of a section along a rolling direction and a section along a direction perpendicular thereto. For example, the maximum length of the connection portion is 32 $\mu$m in FIG. 1. On the other hand, the length of the connection portion per 1 mm of the interface is determined by determining a ratio of connection portion lengths from the observation over the length of not less than 250 $\mu$m at the section along the direction perpendicular to the rolling direction and then converting it into a value per 1 mm. In the embodiment of FIG. 1, the length of the connection portion is 0.15 mm per 1 mm as determined from a ratio of 42 $\mu$m in total of 32 $\mu$m, 8 $\mu$m and 2 $\mu$m to an observed length at the interface of 283 $\mu$m.

Although the remaining iron oxide layer is not distinguished in the microscopic observation of the section of the plated steel sheet shown in FIG. 1, there is a case that the iron oxide layer may contacts with the plated layer through a reduced iron layer because the surface of the iron oxide layer is reduced in the annealing. Thus, even if the very thin reduced iron layer is interposed between the remaining iron oxide layer and the plated layer, the iron oxide layer contacts with the plated layer.

Moreover, the plating adhesion property is evaluated by a ball impact test and a 180° outward bending test. In the ball impact test, an impact core having a semi-spherical convex face of ½ inch in diameter is put onto a back face of the plated steel sheet and a saucer having a semi-spherical concave face is put onto a face of the sheet to be tested, and then a weight of 2 kg is dropped down from a height of 70 cm to strike the impact core, whereby the sheet face to be tested is protruded and an adhesive cellophane tape is adhered thereto and peeled off therefrom to observe the surface of the plated steel sheet. In the 180° outward bending test, an adhesive vinyl tape is adhered to a face of the plated steel sheet to be tested and then the sheet face to be tested is bent outward by 180° by means of hydraulic pressing machine using a steel plate of 0.9 mm in thickness as a spacer and again returned into a flat state, and thereafter the tape is peeled off to observe the surface of the plated steel sheet.

TABLE 1

| | (wt %) | | | | | | | | | | | | |
|---|---|---|---|---|---|---|---|---|---|---|---|---|---|
| | C | Si | Mn | Cr | Ni | Al | Ti | Nb | B | P | S | N | O |
| A | 0.04 | tr. | 0.2 | — | — | 0.02 | — | — | — | 0.02 | 0.01 | 0.003 | 0.004 |
| B | 0.09 | 0.01 | 1.0 | — | — | 0.02 | — | — | — | 0.01 | 0.005 | 0.003 | 0.004 |
| C | 0.05 | 1.0 | 1.4 | — | — | 0.04 | 0.01 | — | 0.0005 | 0.01 | 0.003 | 0.002 | 0.003 |
| D | 0.07 | 1.6 | 1.7 | — | — | 0.04 | 0.10 | — | 0.0005 | 0.01 | 0.003 | 0.002 | 0.003 |

TABLE 1-continued

| | C | Si | Mn | Cr | Ni | Al | Ti | Nb | B | P | S | N | O |
|---|---|---|---|---|---|---|---|---|---|---|---|---|---|
| | (wt %) | | | | | | | | | | | | |
| E | 0.002 | 1.0 | 1.0 | — | — | 0.04 | — | 0.03 | 0.003 | 0.05 | 0.03 | 0.002 | 0.002 |
| F | 0.002 | 1.4 | 2.1 | — | 1.1 | 0.05 | 0.03 | 0.04 | 0.004 | 0.12 | 0.005 | 0.002 | 0.003 |
| G | 0.009 | 0.3 | 0.3 | 11.3 | 0.05 | 0.05 | 0.31 | — | — | 0.03 | 0.003 | 0.008 | 0.004 |
| H | 0.06 | 0.4 | 0.6 | 16.2 | 0.1 | 0.01 | — | — | — | 0.03 | 0.006 | 0.02 | 0.002 |
| I | 0.05 | 0.6 | 1.0 | 18.2 | 9.1 | 0.002 | — | — | — | 0.03 | 0.006 | 0.03 | 0.006 |

TABLE 2

| No. | Kind of steel | Hot rolling finish temperature (° C.) | Coiling temperature (° C.) | Thickness of iron oxide layer (μm) | Reduction treatment hydrogen (%) | Reduction treatment temperature (° C.) | Reduction treatment time (s) | Maximum length of connection portion at interface (μm) | Total length of connection portions per 1 mm of interface | Remarks |
|---|---|---|---|---|---|---|---|---|---|---|
| 1 | A | 850 | 600 | 7.8 | 20 | 500 | 150 | 0 | 0 | Comparative Example |
| 2 | A | 850 | 600 | 7.8 | 20 | 700 | 60 | 0 | 0 | Comparative Example |
| 3 | A | 850 | 600 | 7.8 | 20 | 830 | 150 | 15 | 0.12 | Invention Example |
| 4 | A | 770 | 540 | 5.2 | 20 | 700 | 60 | 0 | 0 | Comparative Example |
| 5 | A | 770 | 540 | 5.2 | 20 | 800 | 20 | 5 | 0.03 | Comparative Example |
| 6 | A | 770 | 540 | 5.2 | 20 | 800 | 40 | 25 | 0.15 | Invention Example |
| 7 | A | 770 | 540 | 5.2 | 20 | 800 | 40 | 25 | o.15 | Invention Example |
| 8 | A | 770 | 540 | 5.2 | 20 | 800 | 50 | 30 | 0.18 | Invention Example |
| 9 | A | 770 | 540 | 5.2 | 20 | 800 | 50 | 30 | 0.18 | Invention Example |
| 10 | A | 770 | 540 | 5.2 | 8 | 800 | 40 | 5 | 0.04 | Comparative Example |
| 11 | A | 770 | 540 | 5.2 | 8 | 800 | 80 | 30 | 0.21 | Invention Example |
| 12 | A | 680 | 500 | 2.3 | 8 | 800 | 30 | 80 | 0.45 | Invention Example |
| 13 | A | 680 | 500 | 2.3 | 8 | 800 | 60 | 120 | 0.60 | Invention Example |

TABLE 3

| No. | Kind of steel | Hot rolling finish temperature (° C.) | Coiling temperature (° C.) | Thickness of iron oxide layer* (μm) | Reduction treatment hydrogen (%) | Reduction treatment temperature (° C.) | Reduction treatment time (s) | Maximum length of connection portion at interface (μm) | Total length of connection portions per 1 mm of interface | Remarks |
|---|---|---|---|---|---|---|---|---|---|---|
| 14 | B | 850 | 600 | 6.8 | 20 | 850 | 80 | 30 | 0.20 | Invention Example |
| 15 | C | 850 | 600 | 6.5 | 20 | 850 | 80 | 30 | 0.20 | Invention Example |
| 16 | D | 850 | 600 | 6.1 | 20 | 850 | 80 | 30 | 0.22 | Invention Example |
| 17 | E | 850 | 600 | 6.4 | 8 | 750 | 60 | 5 | 0.02 | Comparative Example |
| 18 | E | 770 | 540 | 4.2 | 8 | 850 | 60 | 30 | 0.25 | Invention Example |

TABLE 3-continued

| No. | Kind of steel | Hot rolling finish temperature (° C.) | Coiling temperature (° C.) | Thickness of iron oxide layer* (μm) | Reduction treatment hydrogen (%) | Reduction treatment temperature (° C.) | Reduction treatment time (s) | Maximum length of connection portion at interface (μm) | Total length of connection portions per 1 mm of interface | Remarks |
|---|---|---|---|---|---|---|---|---|---|---|
| 19 | F | 770 | 540 | 4.0 | 8 | 850 | 60 | 30 | 0.25 | Invention Example |
| 20 | G | 850 | 600 | 5.6 | 8 | 750 | 40 | 0 | 0 | Comparative Example |
| 21 | G | 770 | 540 | 3.5 | 8 | 900 | 60 | 40 | 0.35 | Invention Example |
| 22 | H | 770 | 600 | 3.5 | 8 | 900 | 60 | 35 | 0.30 | Invention Example |
| 23 | I | 770 | 540 | 3.4 | 8 | 900 | 60 | 35 | 0.35 | Invention Example |

*Each of steels G, H and I contains Cr corresponding to Cr content in steel.

TABLE 4

| No. | Plating bath composition | Plating bath temperature (° C.) | Plating time (s) | Coating weight (g/m$^2$) | Ball impact test * | Outward bending test * | Remarks |
|---|---|---|---|---|---|---|---|
| 1 | Zn-0.2%Al | 460 | 3 | 60 | 4 | 4 | Comparative Example |
| 2 | Zn-0.2%Al | 460 | 3 | 60 | 4 | 4 | Comparative Example |
| 3 | Zn-0.2%Al | 460 | 3 | 60 | 1 | 1 | Invention Example |
| 4 | Zn-0.2%Al | 460 | 3 | 60 | 4 | 3 | Comparative Example |
| 5 | Zn-0.2%Al | 460 | 3 | 60 | 2 | 2 | Comparative Example |
| 6 | Zn-0.2%Al | 460 | 3 | 120 | 1 | 1 | Invention Example |
| 7 | Zn-0.2%Al | 460 | 3 | 220 | 1 | 1 | Invention Example |
| 8 | Zn-0.2%Al | 460 | 3 | 60 | 1 | 1 | Invention Example |
| 9 | Zn-5%Al | 460 | 3 | 120 | 1 | 1 | Invention Example |
| 10 | Zn-5%Al | 460 | 3 | 120 | 2 | 2 | Comparative Example |
| 11 | Zn-5%Al | 460 | 3 | 120 | 1 | 1 | Invention Example |
| 12 | Zn-0.2%Al | 460 | 3 | 90 | 1 | 1 | Invention Example |
| 13 | Zn-0.2%Al | 460 | 3 | 90 | 1 | 1 | Invention Example |

*Evaluation standard
1: No change in the plated face after the peeling of the tape (excellent).
2: Small hairiness is created in the plated face after the peeling of the tape.
3: Small peeling is created in the plated face after the peeling of the tape.
4: A greater part of the plated face is peeled after the peeling of the tape (poor).

TABLE 5

| No. | Plating bath composition | Plating bath temperature (° C.) | Plating time (s) | Coating weight (g/m²) | Ball impact test * | Outward bending test * | Remarks |
|---|---|---|---|---|---|---|---|
| 14 | Zn-5%Al | 460 | 3 | 120 | 1 | 1 | Invention Example |
| 15 | Zn-5%Al | 460 | 3 | 180 | 1 | 1 | Invention Example |
| 16 | Zn-5%Al | 460 | 3 | 60 | 1 | 1 | Invention Example |
| 17 | Zn-0.2%Al | 460 | 3 | 90 | 4 | 3 | Comparative Example |
| 18 | Zn-0.2%Al | 460 | 3 | 90 | 1 | 1 | Invention Example |
| 19 | Zn-0.2%Al | 460 | 3 | 90 | 1 | 1 | Invention Example |
| 20 | Zn-0.2%Al | 460 | 3 | 120 | 4 | 4 | Comparative Example |
| 21 | Zn-0.2%Al | 460 | 3 | 120 | 1 | 1 | Invention Example |
| 22 | Zn-0.2%Al | 460 | 3 | 120 | 1 | 1 | Invention Example |
| 23 | Zn-0.2%Al | 460 | 3 | 120 | 1 | 1 | Invention Example |

*Evaluation standard
1: No change in the plated face after the peeling of the tape (excellent).
2: Small hairiness is created in the plated face after the peeling of the tape.
3: Small peeling is created in the plated face after the peeling of the tape.
4: A greater part of the plated face is peeled after the peeling of the tape (poor).

As seen from Tables 2 to 5, when the total length of the connection portions in the iron oxide layer is not less than 0.1 mm per 1 mm of the interface, good results are obtained in all of the ball impact test and the 180° outward bending test.

And also, the similar evaluation is carried out with respect to an alloyed Zn hot dipping. That is, the same test specimen as mentioned above is prepared by using the slab having a steel composition shown in Table 1. In Tables 6 and 7 are shown hot rolling conditions and reduction conditions before the plating, and the alloyed hot dip galvanizing conditions are shown in Tables 8 and 9, respectively. With respect to the thus obtained plated steel sheets, the thickness of the remaining iron oxide layer, maximum length at the interface of the connection portions and total length per 1 mm of the interface are measured from the observation of the section after the plating in the same manner as mentioned above, and also the plating adhesion property is evaluated. The measured results are also shown in Tables 6 and 7, and the evaluation results are also shown in Tables 8 and 9, respectively.

Moreover, the plating adhesion property is evaluated in a 90° inward bending test and a 180° outward bending test. That is, after an adhesive vinyl tape is adhered to a face of the plated steel sheet to be tested, the face to be tested is bent inward by 90° along a die having a radius of 1 mm and again returned into a flat state in the 90° inward bending test, while the face to be tested is bent outward by 180° by means of a hydraulic pressing machine using a steel plate of 0.9 mm as a spacer and again returned into a flat state in the 180° outward bending test, and thereafter the tape is peeled off to observe the surface of the plated steel sheet.

TABLE 6

| No. | Kind of steel | Hot rolling finish temperature (° C.) | Coiling temperature (° C.) | Thickness of iron oxide layer (μm) | Reduction treatment hydrogen (%) | Reduction treatment temperature (° C.) | Reduction treatment time (s) | Maximum length of connection portion at interface (μm) | Total length of connection portions per 1 mm of interface | Remarks |
|---|---|---|---|---|---|---|---|---|---|---|
| 31 | A | 850 | 600 | 7.8 | 20 | 500 | 150 | 0 | 0 | Comparative Example |
| 32 | A | 850 | 600 | 7.8 | 20 | 700 | 60 | 0 | 0 | Comparative Example |
| 33 | A | 850 | 600 | 7.8 | 20 | 830 | 150 | 15 | 0.12 | Invention Example |
| 34 | A | 770 | 540 | 5.2 | 20 | 700 | 60 | 0 | 0 | Comparative Example |
| 35 | A | 770 | 540 | 5.2 | 20 | 800 | 30 | 12 | 0.10 | Invention Example |
| 36 | A | 770 | 540 | 5.2 | 20 | 800 | 40 | 25 | 0.15 | Invention Example |
| 37 | A | 770 | 540 | 5.2 | 20 | 800 | 40 | 22 | 0.15 | Invention |

TABLE 6-continued

| No. | Kind of steel | Hot rolling finish temperature (° C.) | Coiling temperature (° C.) | Thickness of iron oxide layer (μm) | Reduction treatment hydrogen (%) | Reduction treatment temperature (° C.) | Reduction treatment time (s) | Maximum length of connection portion at interface (μm) | Total length of connection portions per 1 mm of interface | Remarks |
|---|---|---|---|---|---|---|---|---|---|---|
| 38 | A | 770 | 540 | 5.2 | 20 | 800 | 50 | 27 | 0.17 | Example Invention |
| 39 | A | 770 | 540 | 5.2 | 20 | 800 | 50 | 30 | 0.18 | Example Invention |
| 40 | A | 770 | 540 | 5.2 | 8 | 800 | 40 | 5 | 0.04 | Example Comparative |
| 41 | A | 770 | 540 | 5.2 | 8 | 800 | 80 | 30 | 0.21 | Example Invention |
| 42 | A | 680 | 500 | 2.3 | 8 | 800 | 30 | 85 | 0.47 | Example Invention |
| 43 | A | 680 | 500 | 2.3 | 8 | 600 | 30 | 0 | 0 | Example Comparative |
| | | | | | | | | | | Example |

TABLE 7

| No. | Kind of steel | Hot rolling finish temperature (° C.) | Coiling temperature (° C.) | Thickness of iron oxide layer* (μm) | Reduction treatment hydrogen (%) | Reduction treatment temperature (° C.) | Reduction treatment time (s) | Maximum length of connection portion at interface (μm) | Total length of connection portions per 1 mm of interface | Remarks |
|---|---|---|---|---|---|---|---|---|---|---|
| 44 | B | 850 | 600 | 6.8 | 20 | 850 | 80 | 30 | 0.20 | Invention Example |
| 45 | B | 850 | 600 | 6.8 | 20 | 850 | 80 | 30 | 0.20 | Invention Example |
| 46 | C | 850 | 600 | 6.5 | 20 | 850 | 80 | 30 | 0.22 | Invention Example |
| 47 | D | 850 | 600 | 6.1 | 20 | 850 | 80 | 30 | 0.20 | Invention Example |
| 48 | E | 850 | 600 | 6.4 | 8 | 750 | 60 | 5 | 0.02 | Comparative Example |
| 49 | E | 770 | 540 | 4.2 | 8 | 850 | 60 | 30 | 0.25 | Invention Example |
| 50 | F | 770 | 540 | 4.0 | 8 | 850 | 60 | 30 | 0.25 | Invention Example |
| 51 | F | 770 | 540 | 4.0 | 8 | 850 | 60 | 30 | 0.25 | Invention Example |
| 52 | G | 850 | 600 | 5.6 | 8 | 750 | 40 | 0 | 0 | Comparative Example |
| 53 | G | 770 | 540 | 3.5 | 8 | 900 | 60 | 40 | 0.35 | Invention Example |
| 54 | H | 770 | 600 | 3.5 | 8 | 900 | 60 | 35 | 0.30 | Invention Example |
| 55 | I | 770 | 540 | 3.4 | 8 | 900 | 60 | 35 | 0.35 | Invention Example |

*Each of steels G, H and I contains Cr corresponding to Cr content in steel.

TABLE 8

| No. | Plating bath Al concentration (%) | Plating bath temperature (° C.) | Plating time (s) | Alloying temperature (° C.) | Coating weight (g/m$^2$) | Fe concentration of plating (%) | Al concentration of plating (%) | Plated appearance | Evaluation of plating adhesion property* 90° inward bending | Evaluation of plating adhesion property* 180° outward bending | Remarks |
|---|---|---|---|---|---|---|---|---|---|---|---|
| 31 | 0.14 | 460 | 3 | 480 | 60 | 10.3 | 0.27 | good | 4 | 4 | Comparative Example |
| 32 | 0.14 | 460 | 3 | 480 | 60 | 10.5 | 0.27 | good | 4 | 4 | Comparative Example |
| 33 | 0.14 | 460 | 3 | 500 | 60 | 11.8 | 0.26 | good | 1 | 1 | Invention Example |
| 34 | 0.14 | 460 | 3 | 500 | 60 | 8.2 | 0.27 | good | 3 | 3 | Comparative Example |
| 35 | 0.18 | 460 | 3 | 500 | 25 | 8.5 | 1.4 | good | 1 | 1 | Invention Example |
| 36 | 0.14 | 460 | 3 | 500 | 60 | 6.2 | 0.28 | η phase remains | 1 | 1 | Invention Example |
| 37 | 0.14 | 460 | 3 | 500 | 100 | 10.8 | 0.18 | good | 1 | 1 | Invention Example |
| 38 | 0.15 | 460 | 3 | 500 | 40 | 11.5 | 0.4 | good | 1 | 1 | Invention Example |
| 39 | 0.18 | 460 | 3 | 500 | 40 | 10.5 | 0.91 | good | 1 | 1 | Invention Example |
| 40 | 0.15 | 460 | 3 | 500 | 60 | 12.8 | 0.32 | good | 3 | 3 | Comparative Example |
| 41 | 0.15 | 460 | 3 | 480 | 60 | 10.3 | 0.34 | good | 1 | 1 | Invention Example |
| 42 | 0.15 | 460 | 3 | 480 | 60 | 10.1 | 0.33 | good | 1 | 1 | Invention Example |
| 43 | 0.18 | 460 | 3 | 480 | 60 | 8.2 | 0.51 | good | 3 | 3 | Comparative Example |

*Evaluation standard
1: Slight change of color in the peeled tape (excellent).
2: Color changes over a full face of the peeled tape.
3: Plated layer is peeied to an extent of substanfiaily covering the peeled tape.
4: Plated layer is peeled to an extent that it can not be caught by the peeled tape (poor).

TABLE 9

| No. | Plating bath Al concentration (%) | Plating bath temperature (° C.) | Plating time (s) | Alloying temperature (° C.) | Coating weight (g/m$^2$) | Fe concentration of plating (%) | Al concentration of plating (%) | Plated appearance | Evaluation of plating adhesion property* 90° inward bending | Evaluation of plating adhesion property* 180° outward bending | Remarks |
|---|---|---|---|---|---|---|---|---|---|---|---|
| 44 | 0.18 | 460 | 3 | 500 | 25 | 8.6 | 1.3 | good | 1 | 1 | Invention Example |
| 45 | 0.14 | 460 | 3 | 480 | 60 | 9.1 | 0.27 | good | 1 | 1 | Invention Example |
| 46 | 0.14 | 460 | 3 | 480 | 60 | 10.3 | 0.27 | good | 1 | 1 | Invention Example |
| 47 | 0.14 | 460 | 3 | 480 | 60 | 10.1 | 0.27 | good | 1 | 1 | Invention Example |
| 48 | 0.14 | 460 | 3 | 480 | 60 | 9.8 | 0.27 | good | 4 | 3 | Comparative Example |
| 49 | 0.14 | 460 | 3 | 480 | 100 | 10.1 | 0.18 | good | 2 | 1 | Invention Example |
| 50 | 0.15 | 460 | 3 | 480 | 60 | 9.8 | 0.26 | good | 1 | 1 | Invention Example |
| 51 | 0.15 | 460 | 3 | 500 | 60 | 6.0 | 0.27 | η phase remains | 1 | 1 | Invention Example |
| 52 | 0.15 | 460 | 3 | 500 | 45 | 9.5 | 0.27 | good | 4 | 4 | Comparative Example |
| 53 | 0.15 | 460 | 3 | 500 | 60 | 9.5 | 0.27 | good | 1 | 1 | Invention Example |

TABLE 9-continued

| No. | Plating bath: Al concentration (%) | Plating bath: temperature (° C.) | Plating time (s) | Alloying: temperature (° C.) | Coating weight (g/m²) | Fe concentration of plating (%) | Al concentration of plating (%) | Plated appearance | Evaluation of plating adhesion property*: 90° inward bending | Evaluation of plating adhesion property*: 180° outward bending | Remarks |
|---|---|---|---|---|---|---|---|---|---|---|---|
| 54 | 0.15 | 460 | 3 | 500 | 60 | 9.8 | 0.27 | good | 1 | 1 | Invention Example |
| 55 | 0.15 | 460 | 3 | 500 | 60 | 10.1 | 0.27 | good | 1 | 1 | Invention Example |

*Evaluation standard
1: Slight change of color in the peeled tape (excellent).
2: Color changes over a full face of the peeled tape.
3: Plated layer is peeled to an extent of substantially covering the peeled tape.
4: Plated layer is peeled to an extent that it can not be caught by the peeled tape (poor).

As seen from Tables 8 and 9, when the total length of the connection portions in the iron oxide layer is not less than 0.1 mm per 1 mm of the interface, good results are obtained in all of the 90° inward bending test and the 180° outward bending test, and also uniform properties are obtained over a full face of the steel sheet.

Example 2

A slab having a steel composition shown in Table 1 is hot rolled to form a hot rolled sheet provided with an iron oxide layer having a thickness of 0.9 mm. Then, the hot rolled sheet is cut into a test specimen of 60×200 mm after being subjected to a preliminary treatment such as skin-pass rolling or the like, washed with acetone and subjected to a reduction treatment in a vertical type hot metal dipping simulator and further to a hot dip galvanizing. In Tables 10 and 11 are shown conditions for the preliminary treatment and the reduction treatment, while the plating conditions are shown in Tables 12 and 13, respectively. With respect to the thus obtained plated steel sheets, the thickness of the remaining iron oxide layer and the density index D of the connection portion are measured from the observation of the section after the plating, while the plating adhesion property is evaluated. The measured results are shown in Tables 10 and 11, and the evaluation results are shown in Tables 12 and 13, respectively. Moreover, the plating adhesion property is evaluated by the same test as in Example 1.

TABLE 10

| No. | Kind of steel | Hot rolling finish temperature (° C.) | Coiling temperature (° C.) | Thickness of iron oxides layer* (μm) | Preliminary treatment: means | Preliminary treatment: treated amount (%) | Reduction treatment: hydrogen (%) | Reduction treatment: temperature (° C.) | Reduction treatment: time (S) | Thickness of remaining iron oxide layer (μm) | Density Index D | Remarks |
|---|---|---|---|---|---|---|---|---|---|---|---|---|
| 1 | A | 870 | 600 | 8.5 | — | 0 | 20 | 800 | 60 | 7.2 | 48 | Comparative Example |
| 2 | A | 870 | 600 | 8.5 | skin-pass rolling | 1 | 20 | 800 | 60 | 7.2 | 15.2 | Comparative Example |
| 3 | A | 870 | 600 | 8.5 | skin-pass rolling | 2 | 20 | 800 | 60 | 74 | 28.5 | Invention Example |
| 4 | A | 870 | 600 | 8.5 | skin-pass rolling | 3 | 20 | 800 | 60 | 7.4 | 47.7 | Invention Example |
| 5 | A | 870 | 600 | 8.5 | skin-pass rolling | 4 | 20 | 800 | 60 | 7.3 | 51.7 | Invention Example |
| 6 | A | 870 | 600 | 8.5 | skin-pass rolling | 5 | 20 | 830 | 60 | 7.4 | 104.6 | Invention Example |
| 7 | A | 870 | 600 | 8.5 | tensile work | 1 | 20 | 800 | 60 | 7.2 | 14.0 | Comparative Example |
| 8 | A | 870 | 600 | 8.5 | tensile work | 5 | 20 | 800 | 60 | 7.2 | 68.5 | Invention Example |
| 9 | A | 770 | 540 | 5.2 | skin-pass rolling | 3 | 20 | 800 | 20 | 3.8 | 51.7 | Invention Example |
| 10 | A | 770 | 540 | 5.2 | skin-pass rolling | 5 | 20 | 800 | 20 | 3.9 | 72.6 | Invention Example |

TABLE 11

| No. | Kind of steel | Hot rolling finish temperature (° C.) | Coiling temperature (° C.) | Thickness of iron oxides layer* (μm) | Preliminary treatment: means | Preliminary treatment: treated amount (%) | Reduction treatment: hydrogen (%) | Reduction treatment: temperature (° C.) | Reduction treatment: time (S) | Thickness of remaining iron oxide layer (μm) | Density Index D | Remarks |
|---|---|---|---|---|---|---|---|---|---|---|---|---|
| 11 | B | 870 | 600 | 7.4 | skin-pass rolling | 2 | 20 | 800 | 60 | 6.3 | 34.9 | Invention Example |
| 12 | C | 870 | 600 | 7.1 | skin-pass rolling | 2 | 20 | 800 | 60 | 6.0 | 37.9 | Invention Example |
| 13 | D | 870 | 600 | 6.9 | skin-pass rolling | 2 | 20 | 800 | 60 | 5.8 | 34.7 | Invention Example |
| 14 | E | 870 | 600 | 7.1 | — | 0 | 20 | 800 | 60 | 6.0 | 7.6 | Comparative Example |
| 15 | E | 870 | 600 | 7.1 | skin-pass rolling | 2 | 20 | 800 | 60 | 6.0 | 37.9 | Invention Example |
| 16 | E | 870 | 600 | 7.1 | skin-pass rolling | 5 | 20 | 800 | 60 | 4.1 | 68.5 | Invention Example |
| 17 | E | 870 | 600 | 5.3 | skin-pass rolling | 1 | 20 | 800 | 60 | 4.1 | 72.6 | Invention Example |
| 18 | F | 820 | 600 | 5.3 | skin-pass rolling | 1 | 20 | 800 | 60 | 3.9 | 28.5 | Invention Example |
| 19 | G | 820 | 600 | 5.1 | tensile work | 3 | 20 | 800 | 60 | 3.9 | 51.7 | Invention Example |
| 20 | H | 870 | 600 | 6.5 | skin-pass rolling | 1 | 20 | 800 | 60 | 5.2 | 15.2 | Comparative Example |
| 21 | H | 870 | 600 | 6.5 | skin-pass rolling | 2 | 20 | 800 | 60 | 5.3 | 44.1 | Invention Example |
| 22 | I | 870 | 600 | 6.4 | skin-pass rolling | 2 | 20 | 800 | 60 | 5.2 | 44.1 | Invention Example |

*Each of steels G, H and J contains Cr corresponding to Cr content in steel.

35

TABLE 12

| No. | Plating bath: composition | Plating bath: temperature (° C.) | Plating time (S) | Coating weight (g/m$^2$) | Ball impact test (*) | Outward bending test (*) | Remarks |
|---|---|---|---|---|---|---|---|
| 1 | Zn-0.2%Al | 460 | 3 | 60 | 4 | 4 | Comparative Example |
| 2 | Zn-0.2%Al | 460 | 3 | 60 | 2 | 3 | Comparative Example |
| 3 | Zn-0.2%Al | 460 | 3 | 60 | 1 | 1 | Invention Example |
| 4 | Zn-0.2%Al | 460 | 3 | 60 | 1 | 1 | Invention Example |
| 5 | Zn-0.2%Al | 460 | 3 | 220 | 1 | 1 | Invention Example |
| 6 | Zn-5%Al | 460 | 3 | 120 | 1 | 1 | Invention Example |
| 7 | Zn-5%Al | 460 | 3 | 120 | 3 | 3 | Comparative Example |
| 8 | Zn-5%Al | 460 | 3 | 120 | 1 | 1 | Invention Example |
| 9 | Zn-0.2%Al | 460 | 3 | 90 | 1 | 1 | Invention Example |
| 10 | Zn-0.2%Al | 460 | 3 | 90 | 1 | 1 | Invention Example |

*Evaluation standard
1: no change (good)
2: hairiness in plated layer
3: slight peeling of plated layer
4: peeling of plated layer (poor)

TABLE 13

| No. | Plating bath composition | Plating bath temperature (° C.) | Plating time (S) | Coating weight (g/m²) | Ball impact test (*) | Outward bending test (*) | Remarks |
|---|---|---|---|---|---|---|---|
| 11 | Zn-0.2%Al | 460 | 3 | 90 | 1 | 1 | Invention Example |
| 12 | Zn-0.2%Al | 460 | 3 | 90 | 1 | 1 | Invention Example |
| 13 | Zn-0.2%Al | 460 | 3 | 90 | 1 | 1 | Invention Example |
| 14 | Zn-0.2%Al | 460 | 3 | 90 | 4 | 4 | Comparative Example |
| 15 | Zn-0.2%Al | 460 | 3 | 180 | 1 | 1 | Invention Example |
| 16 | Zn-5%Al | 460 | 3 | 120 | 1 | 1 | Invention Example |
| 17 | Zn-5%Al | 460 | 3 | 120 | 1 | 1 | Invention Example |
| 18 | Zn-5%Al | 460 | 3 | 120 | 1 | 1 | Invention Example |
| 19 | Zn-5%Al | 460 | 3 | 90 | 1 | 1 | Invention Example |
| 20 | Zn-5%Al | 460 | 3 | 90 | 4 | 3 | Comparative Example |
| 21 | Zn-0.2%Al | 460 | 3 | 90 | 1 | 1 | Invention Example |
| 22 | Zn-0.2%Al | 460 | 3 | 90 | 1 | 1 | Invention Example |

*Evaluation standard
1: no change (good)
2: hairiness in plated layer
3: slight peeling of plated layer
4: peeling of plated layer (poor)

As seen from Tables 10 to 13, when the density index D of the connection portion connecting the plated layer to the steel matrix is not less than 20, good results are obtained in all of the ball impact test and the 180° outward bending test.

INDUSTRIAL APPLICABILITY

According to the invention, in the plated steel sheet obtained by plating without removing the iron oxide layer, the excellent plating adhesion property can be uniformly given to the full surface of the steel sheet, and there can be provided the plated steel sheet in a low cost. And also, mans for easily forming a plated layer having an excellent adhesion property through hot dipping can be given to steel sheets being difficult to conduct the hot dipping such as high-strength steel sheet, stainless steel sheet and the like.

What is claimed is:

1. A plated steel sheet comprising:

a steel matrix an iron oxide layer a plated layer in the iron oxide layer wherein a connection portion comprising a metallic iron or an iron alloy and connecting the matrix to the plated layer is disposed in the iron oxide layer and wherein said connection portion has a density index D of not less than 20 defined by the equation $D=(D_L^2+D_C^2)^{1/2}$ where $D_L$: number of connection portions in a rolling direction at the section in the thickness direction of the iron oxide layer (portions/mm); and $D_C$: number of connection portions in a direction perpendicular to the rolling direction at the section in the thickness direction of the iron oxide layer (portions/mm).

2. A plated steel sheet according to claim 1, wherein a total length of the connection portion contacting with the plated layer at a section in a thickness direction of a plated steel sheet is not less than 0.1 mm per 1 mm of an interface among the plated layer, iron oxide layer and connection layer.

3. A plated steel sheet according to claim 1, wherein the steel matrix has a composition inclusive of components concentrating into a surface of the steel sheet during the annealing.

4. A plated steel sheet according to claim 3, wherein the steel matrix is a high-strength steel.

5. A plated steel sheet according to claim 3, wherein the steel matrix is a stainless steel.

* * * * *